US006065626A

United States Patent [19]

Huang et al.

[11] Patent Number: 6,065,626

[45] Date of Patent: May 23, 2000

[54] BOX OPENING/CLOSING STRUCTURE

[76] Inventors: Chien Jung Huang, 298, Wu Chyuan S. Rd.; Keh Chang Han, 25, Lane 94 Mei Tsun S. Rd., both of Taichung, Taiwan

[21] Appl. No.: 09/208,636

[22] Filed: Dec. 8, 1998

[51] Int. Cl.[7] ..... B65D 51/18

[52] U.S. Cl. ..... 220/254; 220/792; 220/795; 220/829; 220/833; 220/836; 220/324

[58] Field of Search ..... 220/324, 326, 220/827, 829, 833, 836, 837, 838, 840, 254, 792, 795

[56] References Cited

U.S. PATENT DOCUMENTS

| | | | |
|---|---|---|---|
| 2,580,310 | 12/1951 | Magnenat | 220/827 |
| 2,702,651 | 2/1955 | Graham | 220/827 |
| 2,905,356 | 9/1959 | Jerome | 220/827 X |
| 4,150,779 | 4/1979 | Hibrands | 220/829 X |
| 4,211,337 | 7/1980 | Weavers et al. | 220/840 |
| 5,065,887 | 11/1991 | Schuh et al. | 220/840 X |
| 5,109,980 | 5/1992 | Matsuoka et al. | 220/840 X |
| 5,908,131 | 6/1999 | Yamaguchi | 220/324 |

*Primary Examiner*—Stephen K. Cronin
*Attorney, Agent, or Firm*—Pro-Techtor International Services

[57] ABSTRACT

It is related to an improved box opening/closing structure for storing wet towels for baby. It mainly comprises a box for storing wet towels, a box cover fitted on the box and a lifting cover disposed on the middle of the box cover. When a user wants to open it, just press on the lifting cover, this lifting cover can be opened. When this user wants to close it, just make the lifting cover rotate down and then the lifting cover will be locked with box cover. Therefore, not only an excellent sealing effect can be obtained but also the moisture of the wet towels stored in the box can be kept.

4 Claims, 12 Drawing Sheets

BOX OPENING/CLOSING STRUCTURE

BACKGROUND OF THE INVENTION

This invention relates to an improved opening/closing structure, especially relating to a box opening/closing structure for storing baby's wet towels.

For the conventional wet towel box for baby, as shown in FIGS. 11 and 12, it mainly comprises a box 910, a box cover 920, a lifting cover 930 and a pressing bottom 940 so that a wet towel can be drawn out via the opening 922 of the box cover 920.

Before a package of continuous wet towels (not shown) is opened by a consumer, this package is well sealed and has a certain degree of moisture inside the package. After the package is opened, all the wet towels still is wet enough so that it has the cleaning and lubricating functions for a baby's soft skin. Also, the wet towel will not hurt a baby while a user is cleaning or lubricating it. However, although the wet towel inside the conventional box structure can be easily drawn out, it has another disadvantage of neglecting the moisture keeping effect. That is, after the lifting cover 930 is close on the box cover 920, the first stopping ring 931 is engaged with the second stopping ring 932 of the box cover 920, but there must be some clearances between them. Otherwise, the lifting cover 930 cannot be rotated. In addition, there are some caps at or near the pressing bottom 940 and the resilient plate 950. Due to these clearances and gaps, the wet towel inside the box will be dried out soon. Usually, when the whole package of wet towels is left about one fifth of the original amount, the remaining towels will lose their moisture significantly and becomes useless dry towels. In case the user still using it to clean or lubricate a baby's skin, it is highly possible to create an uncomfortable frictional force on the baby's skin and even to slightly hurt the baby. If the user just throws out the remaining dry towels, it is not only a kind of waste but also an environmental problem.

SUMMARY OF THE INVENTION

The primary object of this invention is to provide an improved box opening/closing structure. By means of the unique locking rod and guiding block, just simply directly pressing on the lifting cover will make the lifting cover open so as to achieve a convenient opening/closing function.

The second object of thus invention is to provide an improved box opening/closing structure. By the design of the pressing disk, spring, and the sealing ring, this invention can enhance the excellent sealing effect so that it can keep the wet towel having proper moisture inside the box.

DETAILED DESCRIPTION OF PREFERRED EMBODIMENTS

Figure 1:
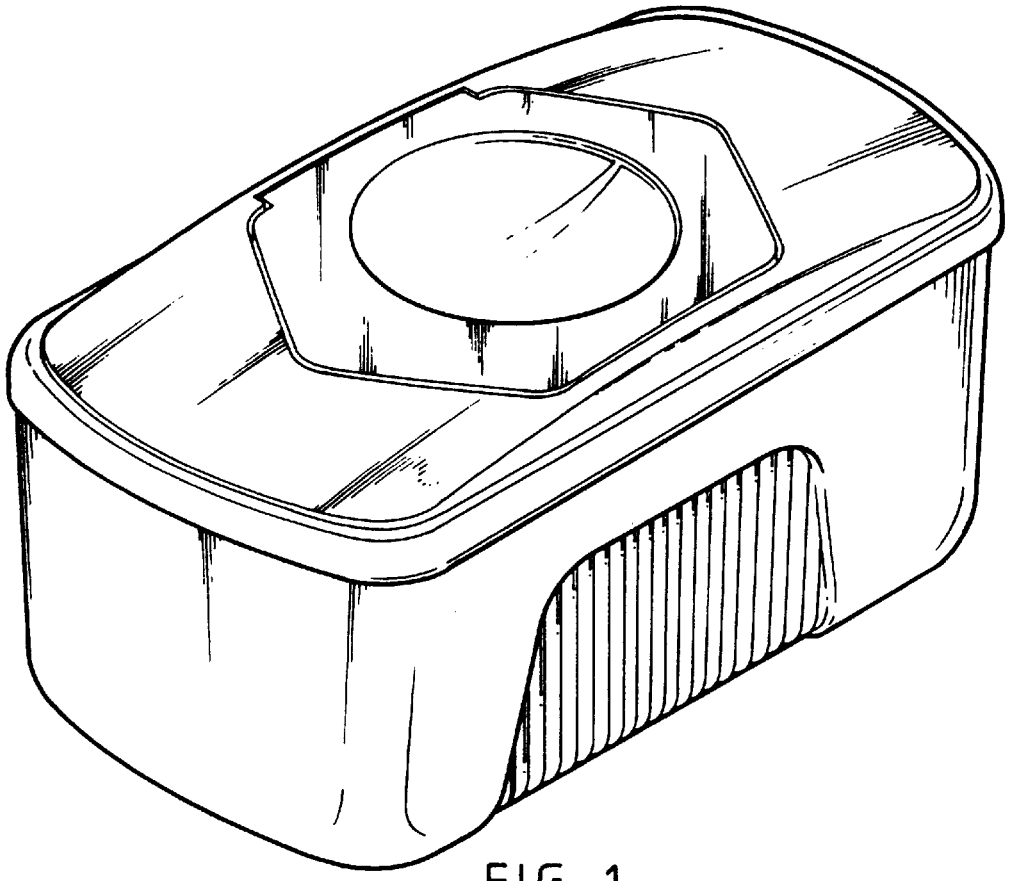
FIG. 1 is a perspective view of the present invention.
Figure 2:
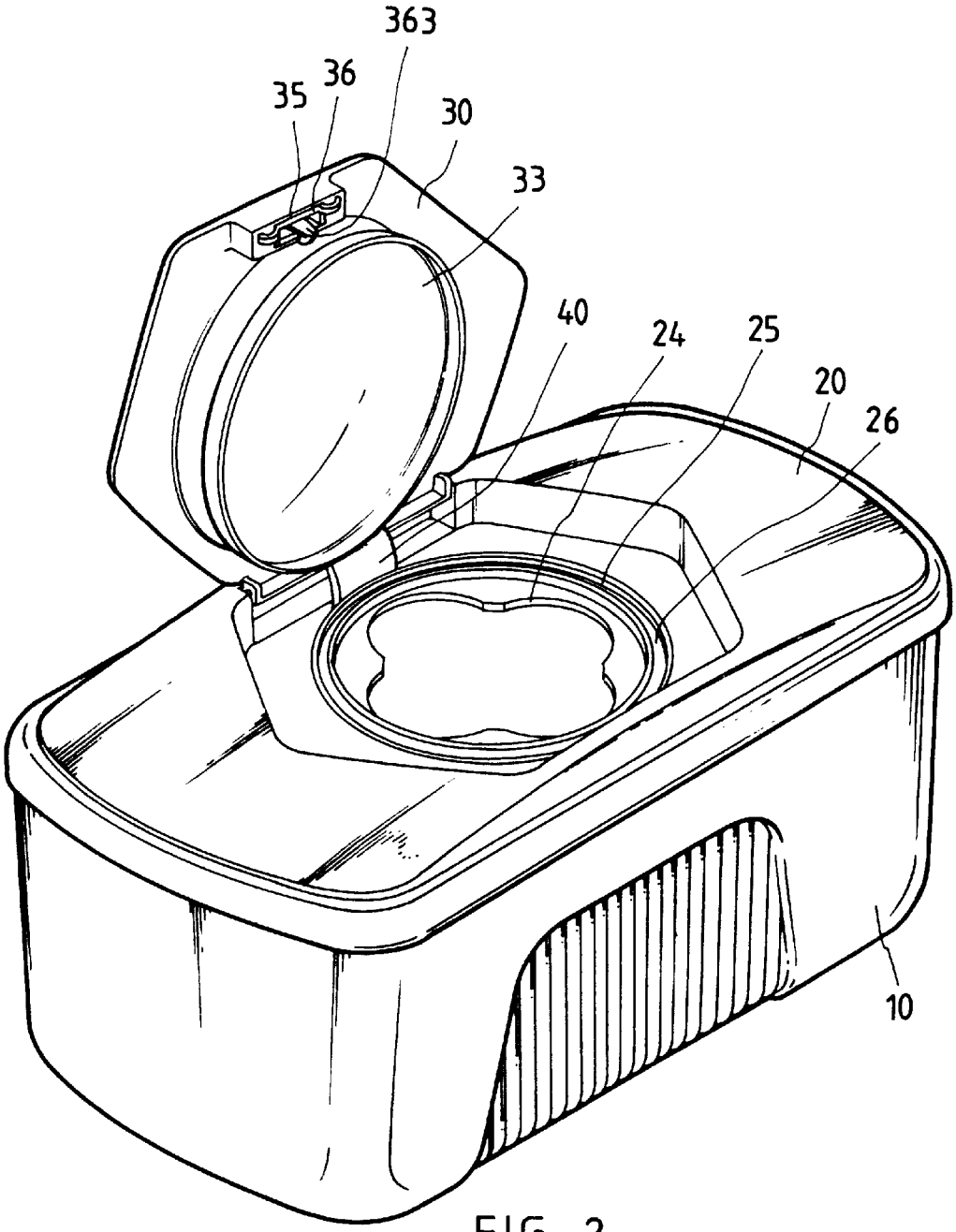
FIG. 2 is a perspective view of this invention when its lifting cover is opened.
Figure 3:
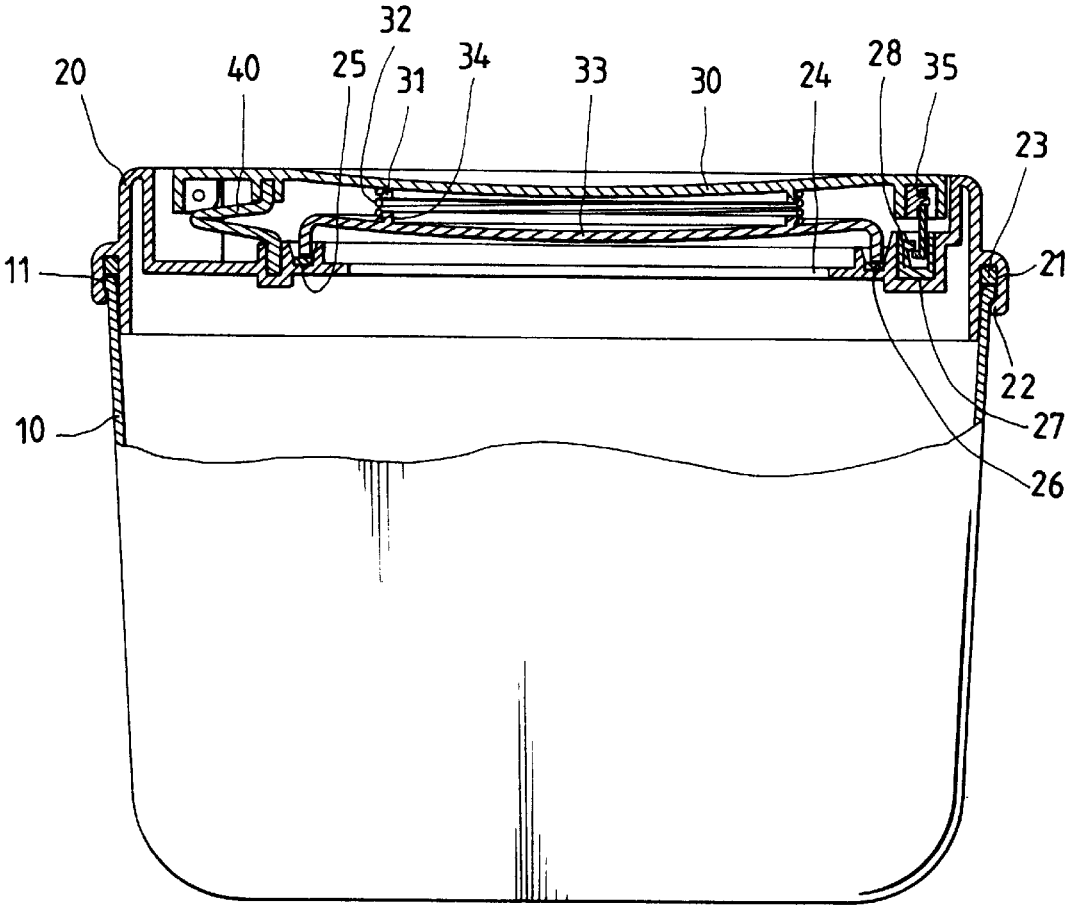
FIG. 3 is a partially cross-sectional view of this invention when its lifting cover is closed.

Referring to FIGS. 1 to 3, the present invention is an improved box opening/closing structure mainly comprising a box 10, a box cover 20, and a lifting cover 30.

Figure 4:
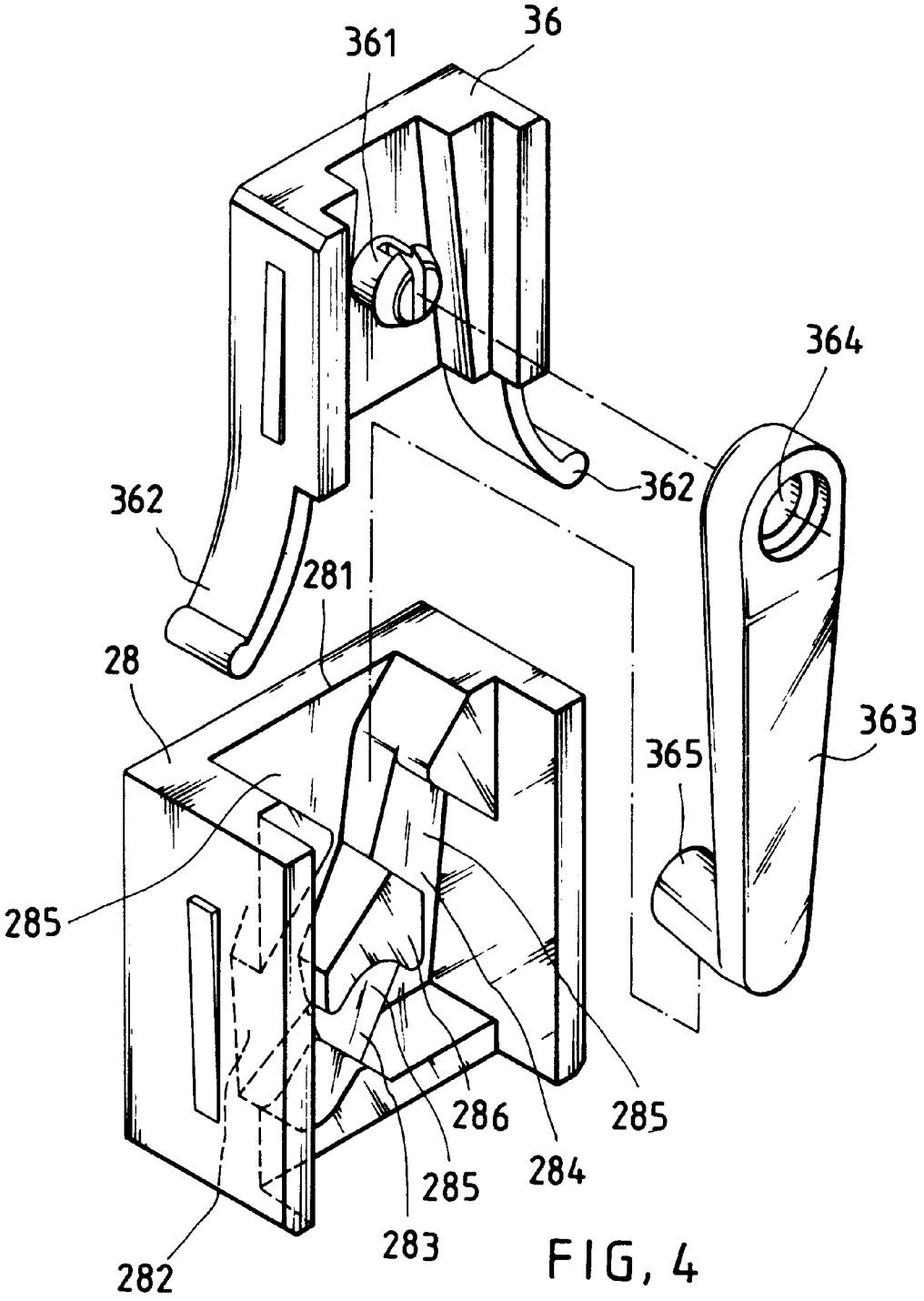
FIG. 4 is exploded view of some part of the invention.
Figure 5:
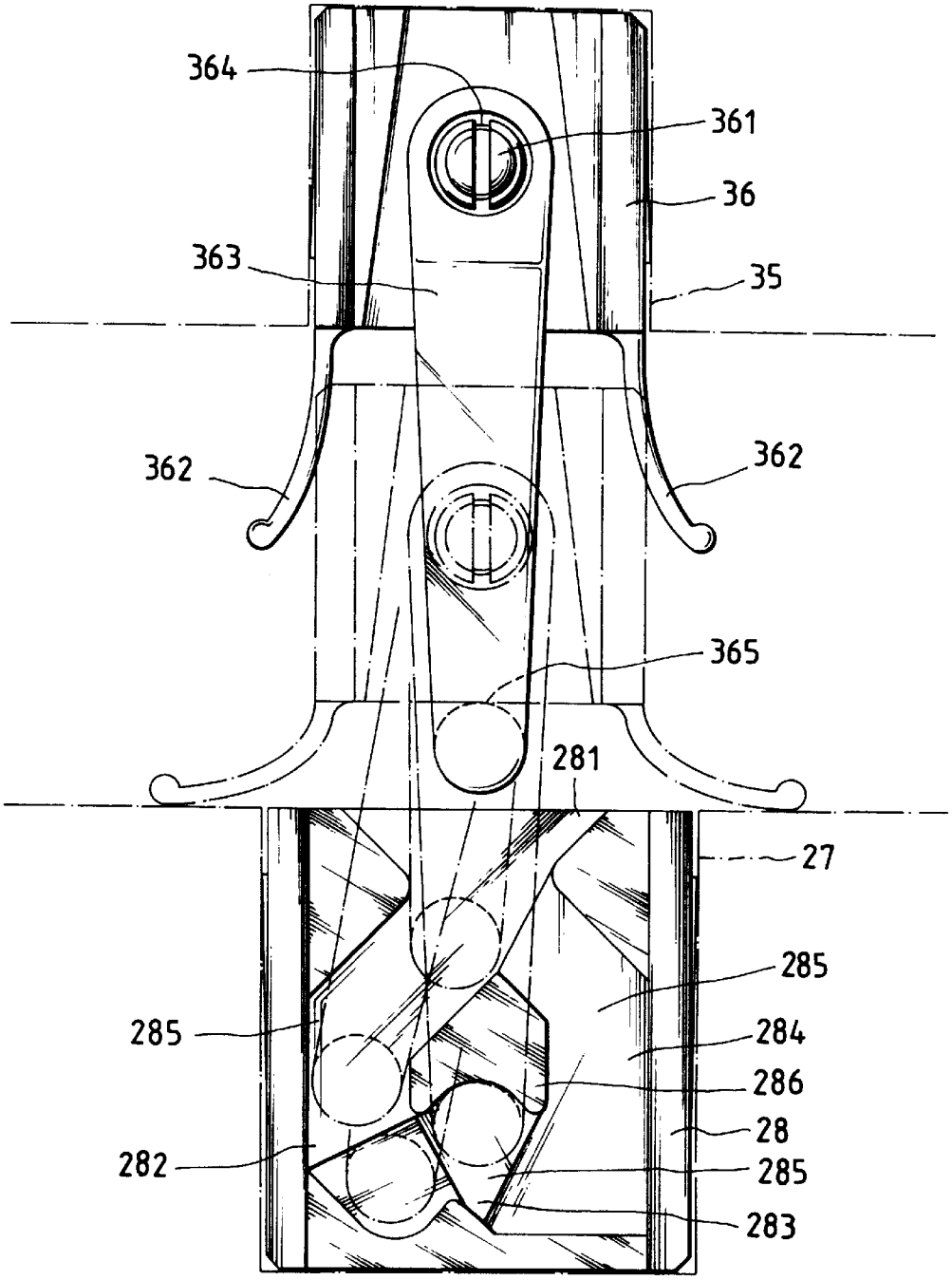
FIG. 5 shows the locking action when the locking rod is engaging with the guiding block.
Figure 6:
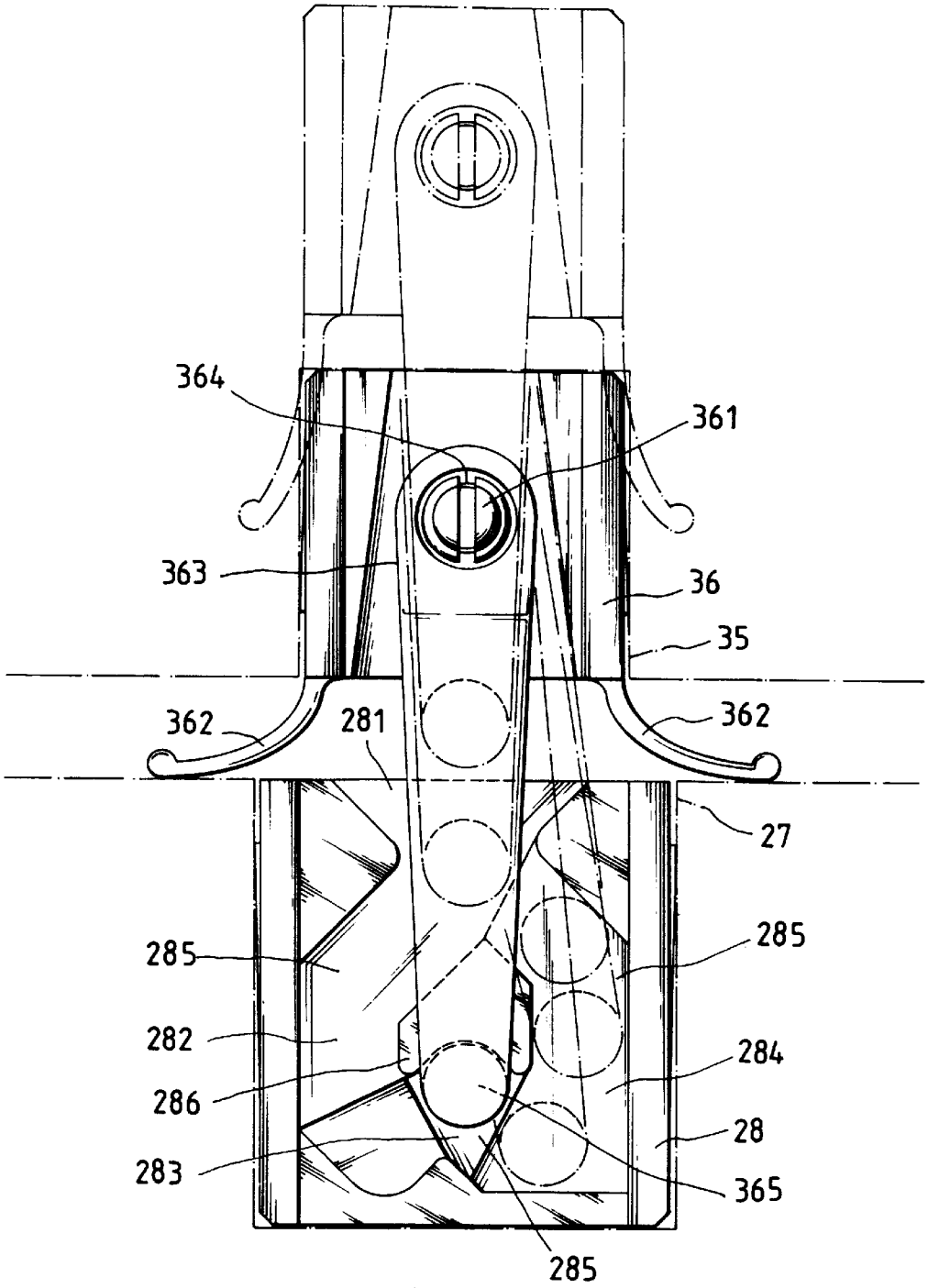
FIG. 6 shows the separating action when the locking rod is leaving the guiding block.

The box 10 is formed as a bowl and has an opening on its top. A round edge 11 is outwardly protruded on the periphery of the edge of the opening. The box cover 20 has a same shape matching the opining. A recess being disposed on a middle of the box cover 20. A circular slot side 21 is disposed on an edge of the box cover 20 and a channel 24 is disposed on an inner side of the circular slot side 21. A sealing ring 26 is disposed in a slot frame 25 near the channel 24. A clutching slot 27 is disposed near the channel 24 so as to engage with a guiding block 28. The guiding block 28 forms like a block (as shown in FIG. 4) and has an end. The end has a guiding in port 281. The guiding port 281 communicates with a guiding slot 282. This guiding slot 282 further communicates with a positioning slot 283. And a guiding out slot 284 is connected with said position in slot 284 and the guiding port 281 so that a loop is formed. Each slot has a slot surface 285 that is a one-way guiding surface. And a stopping block 286 is formed within said loop among these slots 282, 283, 284.

The lifting cover 30 is shaped according to the recess of the box cover 20. A first circular frame rim 31 is disposed on an inner surface of said lifting cover 30 for securing a spring 32. A pressing disk 33 is disposed facing the inner surface with a gap. The pressing disk 33 has a second circular frame rim 34 facing said lifting cover 30 so that this spring 32 can be set within the gap therebetween. A clutching slot 35 is formed away from the first circular frame rim 31 with a predetermined distance for an assembling block 36 to engage with. The assembling block 36 is reversed U-shaped and a connecting rod 361 is disposed on its middle for engaging with a locking rod 363. Two end of the assembling block 36 extends two resilient rods 362 respectively. One end of the locking rod 363 has a hole 364 for connecting with the connecting rod 361. The other end of the locking rod 363 is formed as a hooking rod 365.

Therefore, when a user wants to close the lifting cover 30 on the box cover 20. The hooking rod 365 of the locking rod 363 is guided into the guiding block 28 via said guiding in port 281 After which, it enters into the guiding slot 282 and then slides into the positioning slot 283 along the one-way guiding surface 285 and finally locked by the assembling block 286 due to a balanced resilient force between these two resilient rods 362 so as to secure the lifting cover 30 on said box cover 20; whereas when the user wants to open the lifting cover 30 from the box cover 20, by pressing the lifting cover 30 down, the hooking rod 365 of the locking rod 363 will leave the position slot 283 and pass through the guiding out slot 284 and then move out from the guiding in port 281 along such one-way guiding surface so that the locking rod 363 is separated from the guiding block 28.

Furthermore, when the lifting cover 30 is locked on the box over 20 by the locking rod 363 and the guiding block 28, the lifting cover 30 makes the spring 32 to press on the pressing disk 32 and further press on the sealing ring 26 so as to achieve an excellent sealing effect such that a moisture inside the box can be well kept inside.

Figure 8:
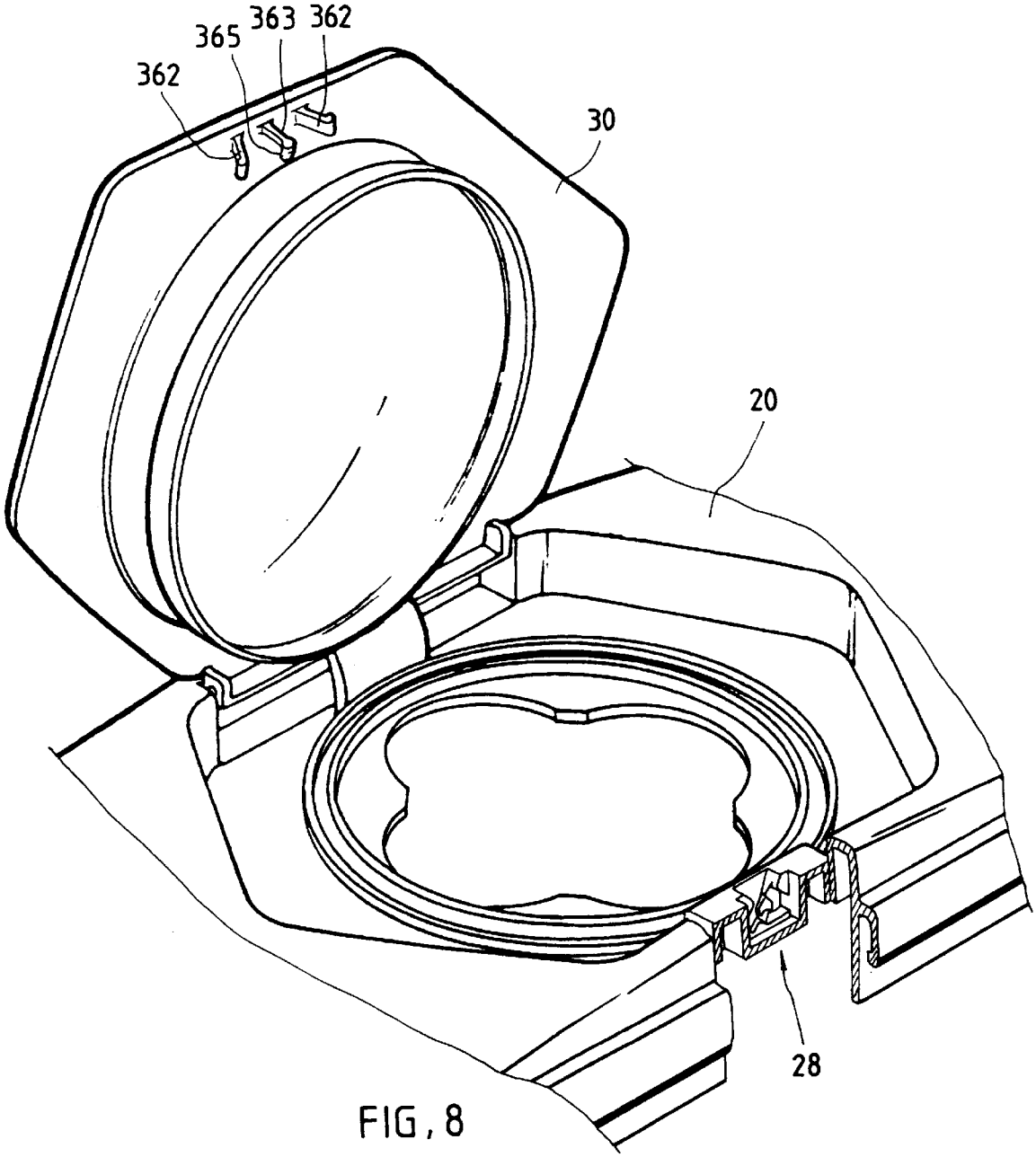
FIG. 8 is a perspective view of the second preferred embodiment.

As illustrated in FIG. 8, it is the second preferred embodiment of the present invention In which, a front end of the lifting cover 30 is integrally formed with the locking rod 363 and two end of the locking rod 363 extends two resilient rods 362 respectively. Also, the guiding block 28 is integrally formed on the box cover 20 facing the locking rod 363. The guiding block 28 has a guiding port 281, a guiding slot 282, a positioning slot 283, a guiding slot 284 and a stopping block 286. So, it also can achieve the above-mentioned functions and results.

Figure 9:
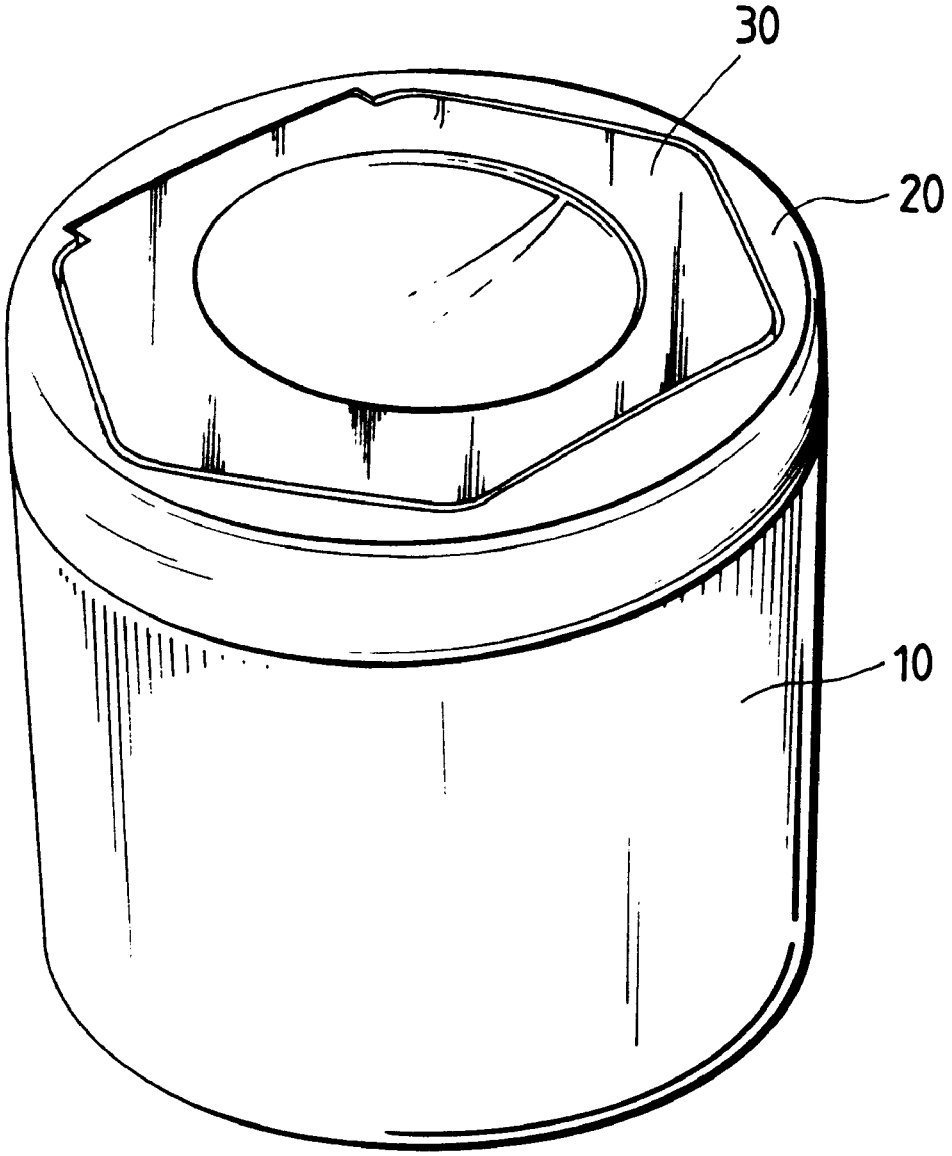
FIG. 9 is a perspective view of another preferred embodiment.
Figure 10:
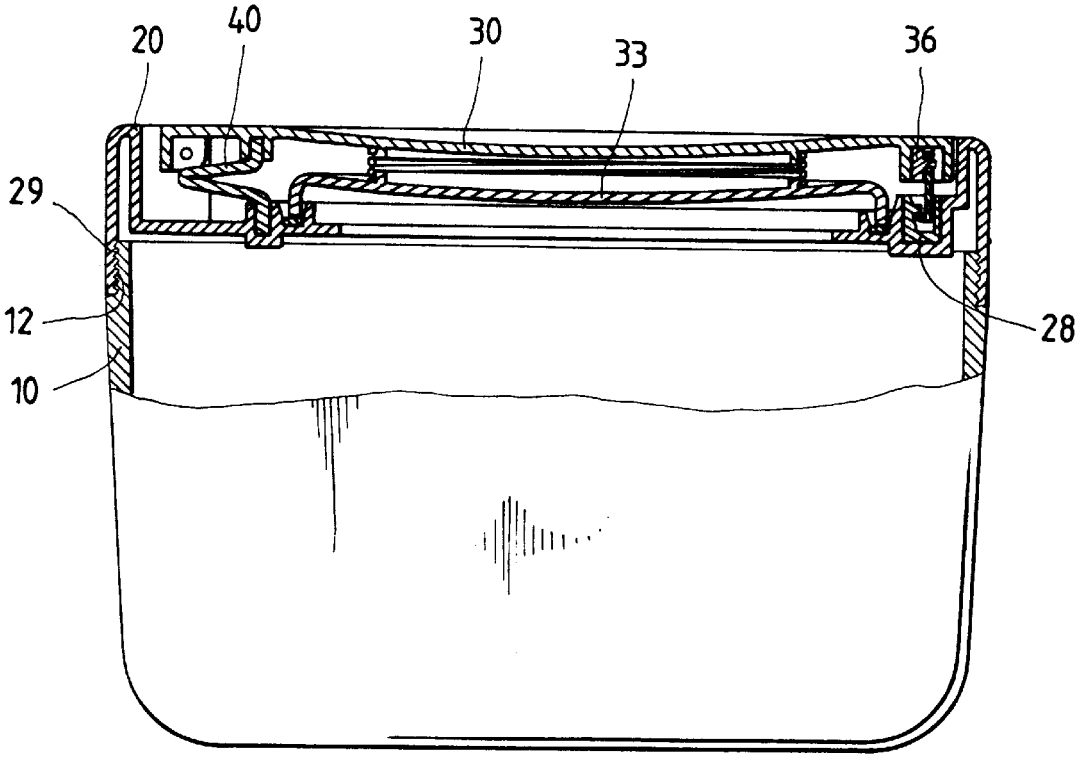
FIG. 10 is a partially cross-sectional view of another embodiment of this invention when its lifting cover is closed.
Figure 11:
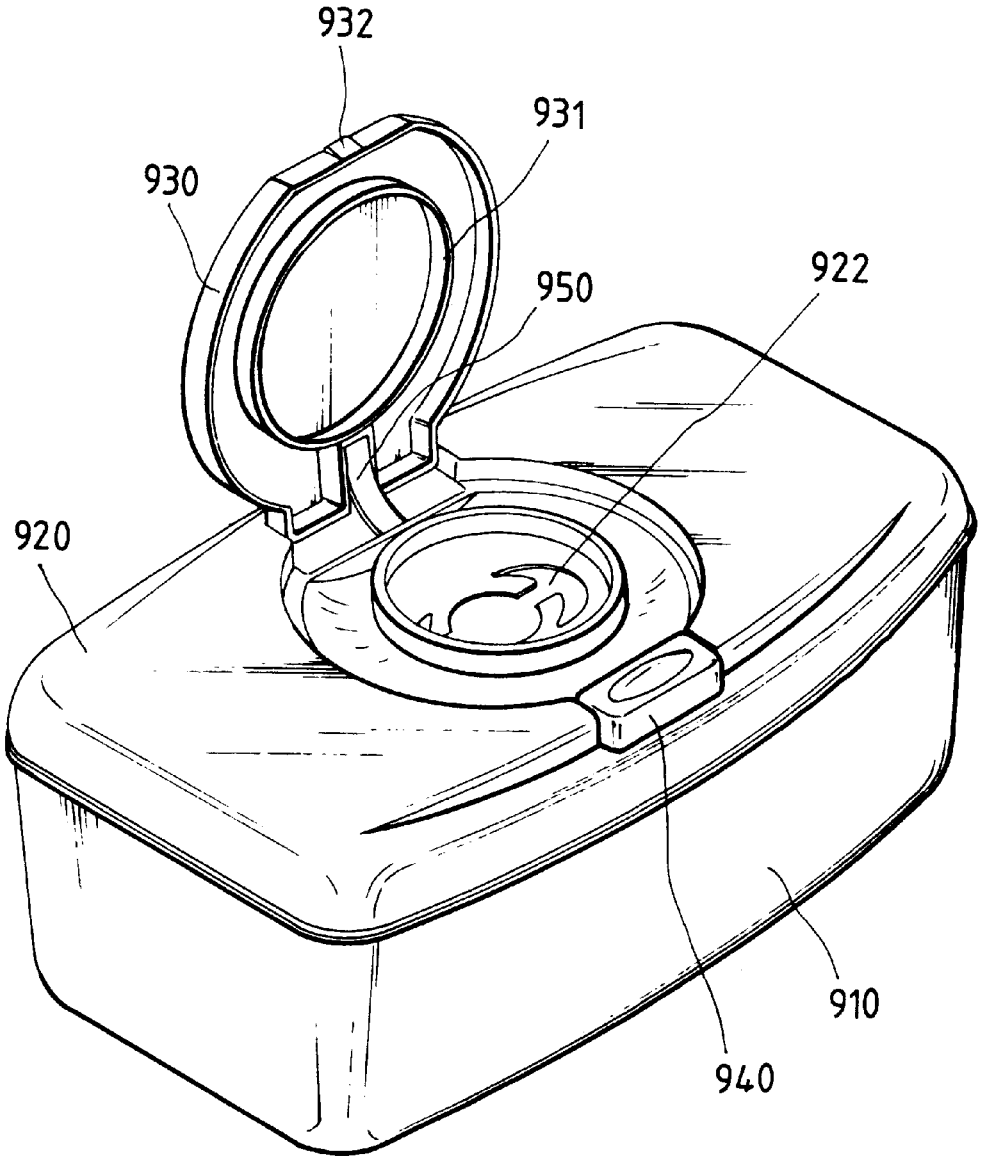
FIG. 11 is a perspective view of a conventional box structure.
Figure 12:
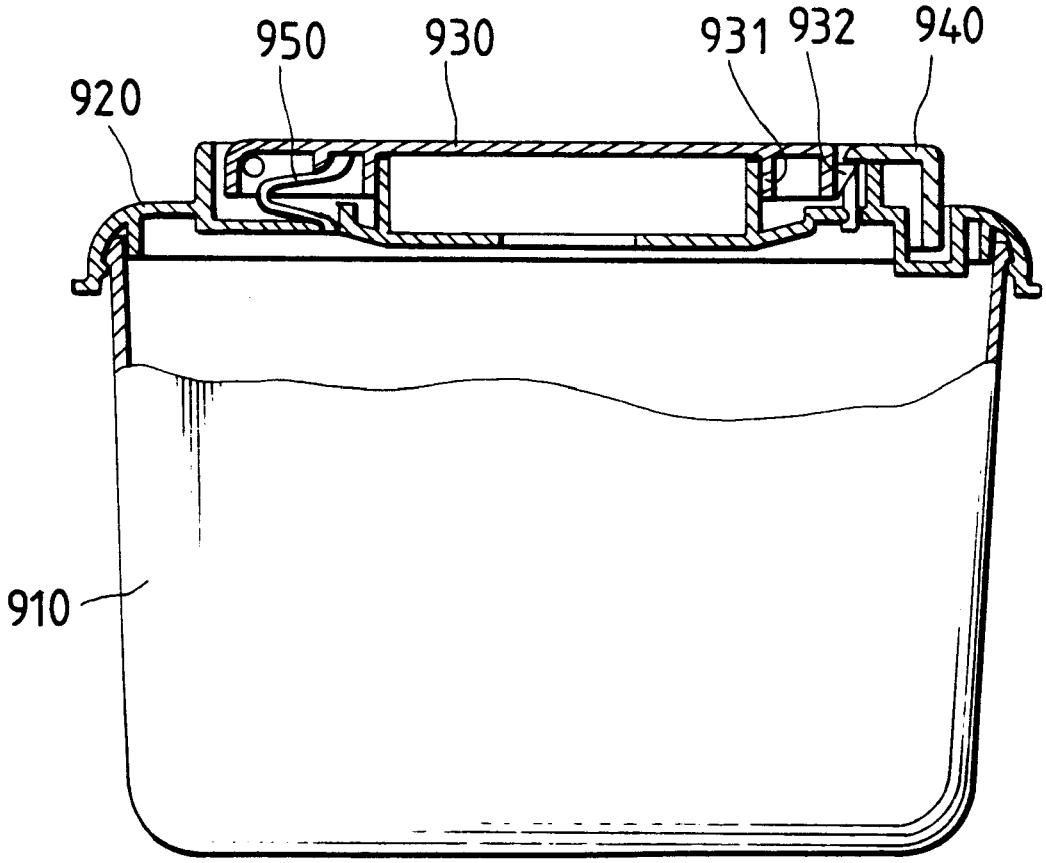
FIG. 12 is a partially correctional view of the conventional structure.

Referring to FIGS. 9 and 10 for another embodiment of this invention, an inner thread 29 is formed on an inner surface of the box cover 20 and an outer thread 12 is formed on an edge of the opening of the box 10 accordingly so that an excellent sealing effect can be obtained, especially for restoring cosmetic cream, liquid or the like.

Figure 7:
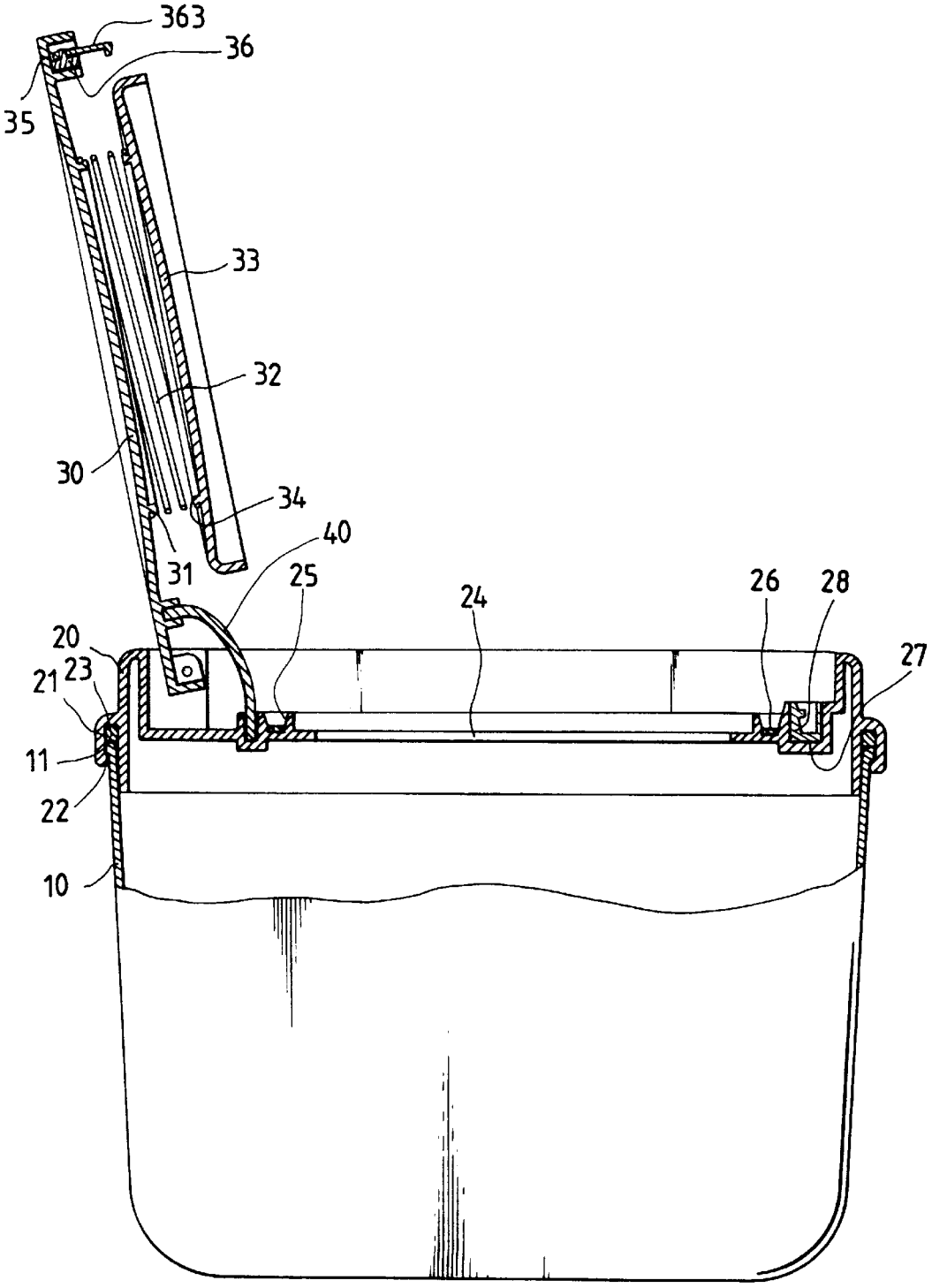
FIG. 7 is a partially cross-sectional view of this invention when its lifting cover is opened.

Of course, as shown in FIG. 7, a resilient plate 40 can be disposed on one end of the lifting cover 30 opposite to the clutching slot 27 so as to achieve an auxiliary opening effect.

What is claimed is:

1. An improved box opening/closing structure comprising a box, a box cover, a lifting cover;

said box having an opening;

said box cover having a same shape of the opining, a recess being disposed on a middle of the box cover, a circular slot side being disposed on an edge of said box cover and a channel being disposed on an inner side of said circular slot side, a sealing ring being disposed in a slot frame near said channel, a clutching slot being disposed near said channel so as to engage with a guiding block, said guiding block having an end, said end having a guiding in port, said guiding port being communicated with a guiding slot, said guiding slot being communicated with a positioning slot, and a guiding out slot being connecting with said guiding port and said positioning slot so that a loop is formed, each slot having a slot surface that is a one-way guiding surface, and a stopping block being formed within said loop among these slots, said lifting cover being shaped according to said recess of the box cover, a first circular frame rim being disposed on an inner surface of said lifting cover for securing a spring, a pressing disk being disposed facing the inner surface with a gap, said pressing disk having a second circular frame rim facing said lifting cover so that the spring can be set within the gap therebetween, a clutching slot being formed away from said first circular frame rim with a predetermined distance for an assembling block to engage with, said assembling block being reversed U-shaped and a connecting rod being disposed on its middle for engaging with a locking rod, two end of said assembling block extending two resilient rods respectively, one end of said locking rod having a hole for connecting with said connecting rod, the other end of said locking rod being formed as a hooking rod;

so that when a user wants to close said lifting cover on said box cover, the hooking rod of said locking rod is guided from said guiding in port into said guiding slot and then slides into said positioning slot along said one-way guiding surface and finally locked by said assembling block due to a balanced resilient force between said two resilient rods so as to secure said lifting cover on said box cover; whereas when the user wants to open said lifting cover from said box cover, by pressing said lifting cover down, said hooking rod of the locking rod will leave said position slot and pass through said guiding out slot and then move out from said guiding in port along such one-way guiding surface so that said locking rod is separated from said guiding block; and when said lifting cover is locked on said box cover by said locking rod and said guiding block, said lifting cover makes said spring to press on said pressing disk and further press on said sealing ring so as to achieve an excellent sealing effect such that a moisture inside said box cane be well kept inside.

2. An improved box opening/closing structure as claimed in claim 1, wherein a front end of said lifting cover is integrally formed with said locking rod and two end of said lock rod extends two resilient rods respectively, and wherein said guiding block is integrally formed on said box cover facing said locking rod, said guiding block having a guiding port, a guiding slot, a positioning slot, a guiding slot and a stopping block.

3. An improved box opening/closing structure as claimed in claim 1, wherein a resilient plate is disposed on one end of said lifting cover opposite to said clutching slot so as to achieve an auxiliary opening effect.

4. An improved box opening/closing structure as claimed in claim 1, wherein an inner thread is formed on an inner surface of said box cover and an outer thread is formed on an edge of said opening of said box accordingly so that an excellent sealing effect can be obtained.

* * * * *